US007603048B2

(12) United States Patent
Hasegawa

(10) Patent No.: US 7,603,048 B2
(45) Date of Patent: Oct. 13, 2009

(54) IMAGE FORMING APPARATUS AND CONTROL METHOD THEREOF

(75) Inventor: Satoshi Hasegawa, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 430 days.

(21) Appl. No.: 11/668,571

(22) Filed: Jan. 30, 2007

(65) Prior Publication Data

US 2008/0181623 A1 Jul. 31, 2008

(51) Int. Cl.
*G03G 15/20* (2006.01)

(52) U.S. Cl. ..... 399/68; 399/13; 399/69; 399/88

(58) Field of Classification Search ..... 399/13, 399/67–69, 88
See application file for complete search history.

(56) References Cited

U.S. PATENT DOCUMENTS

2007/0047989 A1* 3/2007 Nakamura et al. ..... 399/67

FOREIGN PATENT DOCUMENTS

JP 2004-070011 3/2004
JP 2004-319431 11/2004

* cited by examiner

*Primary Examiner*—Susan S Lee
(74) *Attorney, Agent, or Firm*—Turocy & Watson, LLP

(57) ABSTRACT

An image forming apparatus according to the invention includes an auxiliary power supply configured to detachably mountable on the image forming apparatus, a fixing device including a main heater heated by a commercial power supply and an auxiliary heater heated by the auxiliary power supply, a detector that detects mounting and detachment of the auxiliary power supply, and a control unit that performs control to carry out, when the mounting of the auxiliary power supply is detected by the detector, continuous printing of sheets at printing speed higher than printing speed at the time when the auxiliary power supply is not mounted. According to the image forming apparatus according to the invention, the image forming apparatus is capable of operating without deteriorating power use efficiency during continuous printing at normal speed and, on the other hand, can secure stable fixing performance even when the speed of the continuous printing is increased.

19 Claims, 9 Drawing Sheets

IMAGE FORMING APPARATUS AND CONTROL METHOD THEREOF

BACKGROUND OF THE INVENTION

1. Field of the Invention

The present invention relates to an image forming apparatus and a control method thereof, and, more particularly to an image forming apparatus employing an electrophotographic system and a control method thereof.

2. Description of the Related Art

In an image forming apparatus such as a copying machine employing an electrophotographic system, a process for developing an electrostatic latent image formed on a photoconductive drum using a toner or the like, transferring a toner image developed onto a sheet, and then heating and pressing the toner image with a fixing device to fix the toner image on the sheet is adopted.

As a structure of the fixing device, a form of using a heating roller having a heater built therein is often adopted. The toner image on the sheet is fixed by directly applying heat of the heating roller to the sheet or indirectly applying the heat to the sheet via a fixing belt or the like.

In order to secure satisfactory fixing performance, it is important to maintain the temperature of the heating roller within a predetermined range.

However, when a large number of sheets are continuously printed, since heat absorbed by the sheets increases, the temperature of the heating roller falls.

On the other hand, since the heating roller is cold during starting of the image forming apparatus, a warm-up time for heating the heating roller using the heater to bring the temperature of the heating roller into the predetermined range is necessary.

In order to maintain the temperature of the heating roller within the predetermined range during continuous printing as well or reduce the warm-up time, techniques including a main heater and an auxiliary heater as heaters are disclosed in, for example, JP-A 2004-070011 and JP-A 2004-319431.

In these disclosed techniques, a commercial power supply is used as a power supply for the main heater and a chargeable auxiliary power supply, for example, an auxiliary power supply employing an electric double layer capacitor is used as a power supply for the auxiliary heater.

The techniques disclosed in JP-A 2004-070011 and JP-A 2004-319431 are forms of always using the main heater and the auxiliary heater complementarily in a state in which an auxiliary power supply for the auxiliary heater is always built in. Therefore, when sheets are subjected to the continuous printing at predetermined specified speed, it is possible to control the temperature of the heating roller to be within the predetermined range by using the auxiliary heater. However, when speed of the continuous printing is increased by specified speed, since the temperature of the heating roller further falls, fixing performance cannot be maintained.

As a general characteristic of a chargeable power supply, discharging electric power is smaller than charging electric power. Thus, power use efficiency inevitably falls in the form of always using both the auxiliary power supply and the commercial power supply complementarily compared with a form of using only the commercial power supply.

SUMMARY OF THE INVENTION

The invention has been devised in view of the above-mentioned circumstances and it is an object of the invention to provide an image forming apparatus that is capable of operating without deteriorating power use efficiency during continuous printing at normal speed and, on the other hand, can secure stable fixing performance even when the speed of the continuous printing is increased and a control method of the image forming apparatus.

In order to attain the object, an image forming apparatus according to an aspect of the invention includes an auxiliary power supply configured to detachably mountable on the image forming apparatus, a fixing device including a main heater heated by a commercial power supply and an auxiliary heater heated by the auxiliary power supply, a detector that detects mounting and detachment of the auxiliary power supply, and a control unit that performs control to carry out, when the mounting of the auxiliary power supply is detected by the detector, continuous printing of sheets at printing speed higher than printing speed at the time when the auxiliary power supply is not mounted.

In order to attain the object, an image forming apparatus according to another aspect of the invention includes means for supplying an auxiliary power supply configured to detachably mountable on the image forming apparatus, fixing means including first heating means heated by a commercial power supply and second heating means heated by the means for supplying the auxiliary power supply, detecting means for detecting mounting and detachment of the auxiliary power supply, and controlling means for performing control to carry out, when the means for supplying the auxiliary power supply is detected by the detecting means, continuous printing of sheets at printing speed higher than printing speed at the time when the means for supplying the auxiliary power supply is not mounted.

In order to attain the object, a control method of an image forming apparatus according to still another aspect of the invention is a control method of an image forming apparatus including an auxiliary power supply configured to detachably mountable on the image forming apparatus and a fixing device including a main heater heated by a commercial power supply and an auxiliary heater heated by the auxiliary power supply, the control method of an image forming apparatus including detecting mounting and detachment of the auxiliary power supply and, when the mounting of the auxiliary power supply is detected, performing control to carry out continuous printing of sheets at printing speed higher than printing speed at the time when the auxiliary power supply is not mounted.

BRIEF DESCRIPTION OF THE DRAWINGS

In the accompanying drawings:

FIG. 4 is a diagram showing an example of a detail structure related to control of a main heater and an auxiliary heater, an auxiliary power supply, and the like;

DETAILED DESCRIPTION OF THE INVENTION

Embodiments of an image forming apparatus and a control method thereof according to the invention will be explained with reference to the accompanying drawings.

(1) Structure of an Image Forming Apparatus

Figure 1:
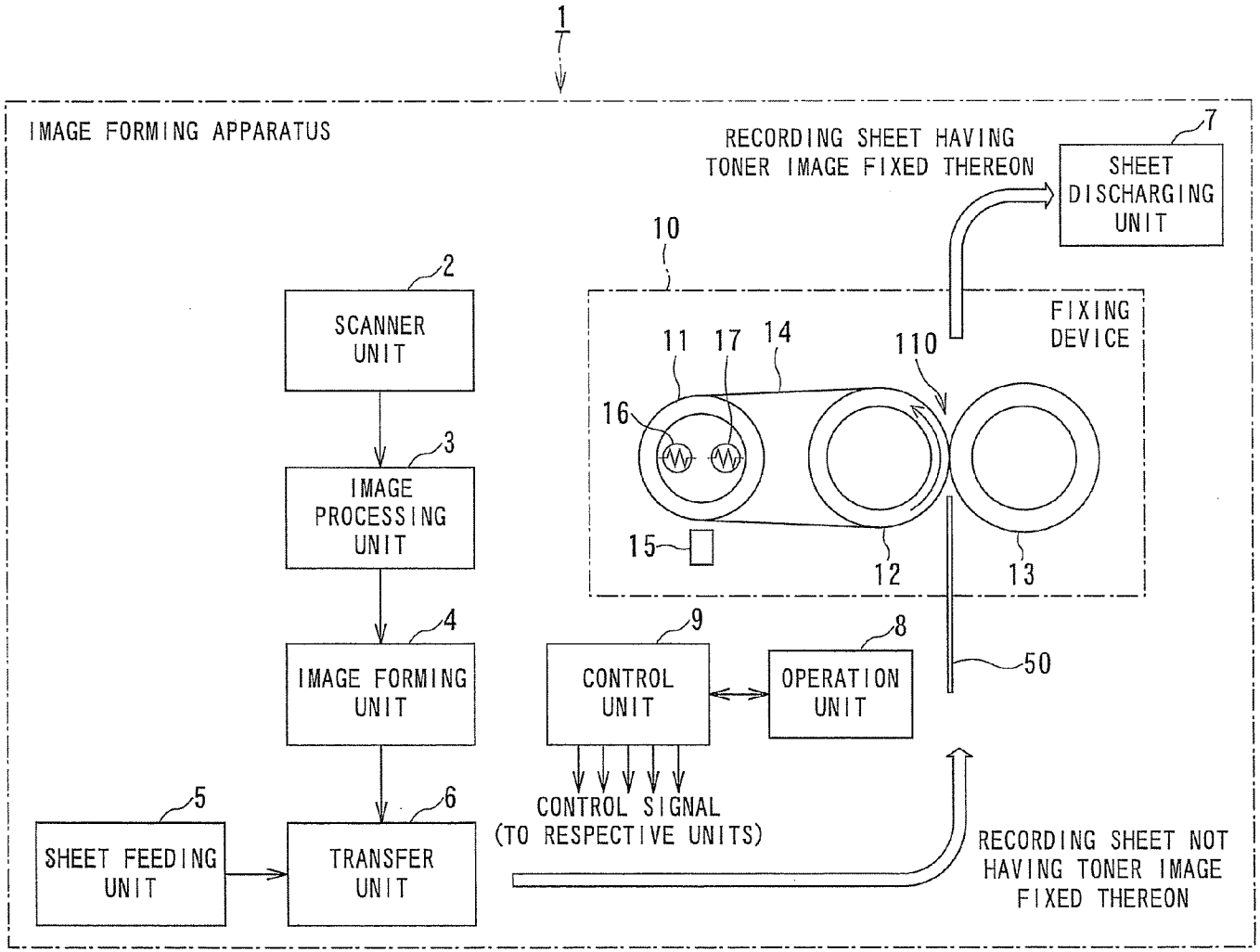
FIG. 1 is a diagram showing an example of an overall structure of an image forming apparatus according to a first embodiment of the invention.

FIG. 1 is a diagram showing an example of a structure of an image forming apparatus 1 according to a first embodiment of the invention.

The image forming apparatus 1 includes, for example, a scanner unit 2, an image processing unit 3, an image forming unit 4, a sheet feeding unit 5, a transfer unit 6, a sheet discharging unit 7, an operation unit 8, a control unit (controlling means) 9, and a fixing device (fixing means) 10.

The scanner unit 2 scans reflected light from an original with, for example, a CCD sensor and converts the reflected light into image data.

The image processing unit 3 applies various kinds of image processing such as color conversion processing, filtering processing, and gradation processing to the image data scanned.

The image forming unit 4 performs, for example, pulse width modulation according to intensity of the image data subjected to the image processing and forms an electrostatic latent image on a photoconductive drum using a laser beam or the like. Moreover, the image forming unit 4 develops the electrostatic latent image with a toner and forms a toner image on the photoconductive drum.

The transfer unit 6 transfers the toner image on the photoconductive drum onto a sheet conveyed from the sheet feeding unit 5. The transfer from the photoconductive drum onto the sheet may be directly performed or the toner image on the photoconductive drum may be intermediately transferred onto an intermediate transfer member once and transferred onto the sheet from the intermediate transfer member again.

A sheet (a sheet not having the toner image fixed thereon) having the toner image transferred thereon is outputted from the transfer unit 6 to the fixing device 10. The sheet having the toner image fixed thereon by the fixing device 10 is outputted to the outside from the sheet discharging unit 7.

The operation unit 8 includes, for example, an operation panel including a liquid crystal display and a touch panel and appropriate keys.

The control unit 9 includes a processor and the like and performs control of the entire image forming apparatus 1. As described later, ON and OFF control of a main heater (first heating means) 16 and an auxiliary heater (second heating means) 17 of the fixing device 10 is also performed by this control unit 9.

FIG. 1 is a diagram showing an example of a structure of the image forming apparatus 1 serving as a copying machine. However, it is also possible to cause the image forming apparatus 1 to function as a printer. In this case, image data created in an external apparatus such as a personal computer is inputted to the image processing unit 3 via an external interface (not shown).

A detail structure of the fixing device 10 will be explained.

The fixing device 10 includes a heating roller 11, a fixing roller 12, a pressure roller 13, and a fixing belt 14. A temperature sensor 15 is disposed near the heating roller.

The fixing belt 14 is an endless belt wound around the heating roller 11 and the fixing roller 12 and turns between the heating roller 11 and the fixing roller 12.

The pressure roller 13 is set in press contact with the fixing roller 12 via the fixing belt 14. The sheet 50 not having a toner image fixed thereon conveyed from the transfer unit 6 is applied with heat and pressure while the sheet 50 passes through a contact portion (a nip portion 110) between the pressure roller 13 and the fixing belt 14 and the unfixed toner image is fixed on the sheet 50.

The fixing belt 14 is formed by using, as a substrate, a thin seamless belt molded from metal such as nickel or heat resistant resin such as polyimide and coating heat resistant rubber such as silicone rubber or fluororubber and fluorine resin impregnated with oil over the surface of the substrate or formed by coating heat resistant highly releasable resin such as PFA (PerFluoro alkoxyl Alkane) tube over silicone rubber.

In this embodiment, a heat resistant elastic layer of silicone rubber coated at the thickness of about 200 μm is provided on an outer peripheral surface of a thin seamless belt formed by nickel electrocasting with the thickness of about 37 μm and a tube with the thickness of about 30 μm is coated over the outer peripheral surface. On the inner side of this fixing belt 14, there are arranged the heating roller 11 and the fixing roller 12. The heating roller 11 heats the fixing belt 14 and applies tension to this fixing belt 14 and the fixing roller 12 that drives the fixing belt 14. The fixing roller 12 forms a fixing area between the fixing roller 12 and the pressure roller 13.

The heating roller 11 according to this embodiment is formed by coating a coating layer of PTFE (Poly TetraFluoro Ethylene) with the thickness of about 20 μm over a core bar of an aluminum pipe with the diameter of about 30 mm and the thickness of about 1 mm.

A main heater 16 and an auxiliary heater 17 are provided in the inside of the heating roller 11 as heat generating sources. The main heater 16 is a shaft-like heater lamp that uses the commercial power supply as a power source. The auxiliary heater 17 is a shaft-like heater lamp that uses a chargeable auxiliary power supply (supplying means of the auxiliary power supply), for example, an electric double layer capacitor as a power source.

In the form shown in FIG. 1, both the main heater 16 and the auxiliary heater 17 are built in the heating roller 11. However, the main heater 16 and the auxiliary heater 17 are not limited to this form.

Figure 2:
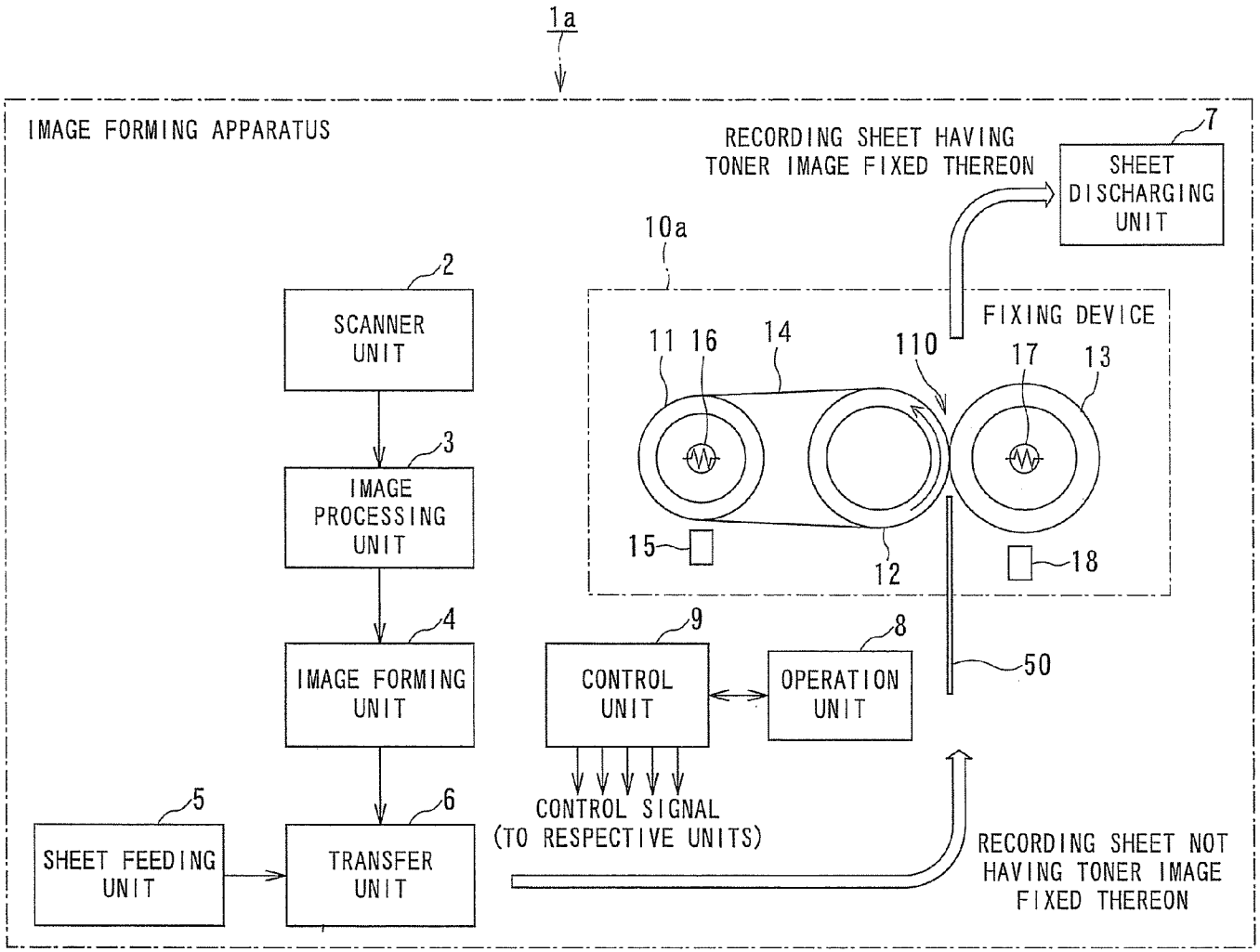
FIG. 2 is a diagram showing an example of an overall structure of an image forming apparatus according to a second embodiment of the invention.

For example, FIG. 2 is a diagram showing an example of a structure of an image forming apparatus 1*a* according to a second embodiment. In this form, the main heater 16 is built in the heating roller 11 and, on the other hand, the auxiliary heater 17 is built in the pressure roller (in this case, performing both pressing and heating) 13. In the second embodiment, in order to detect the temperature of the pressure roller 13, a temperature sensor 18 is provided near the pressure roller.

Figure 3:
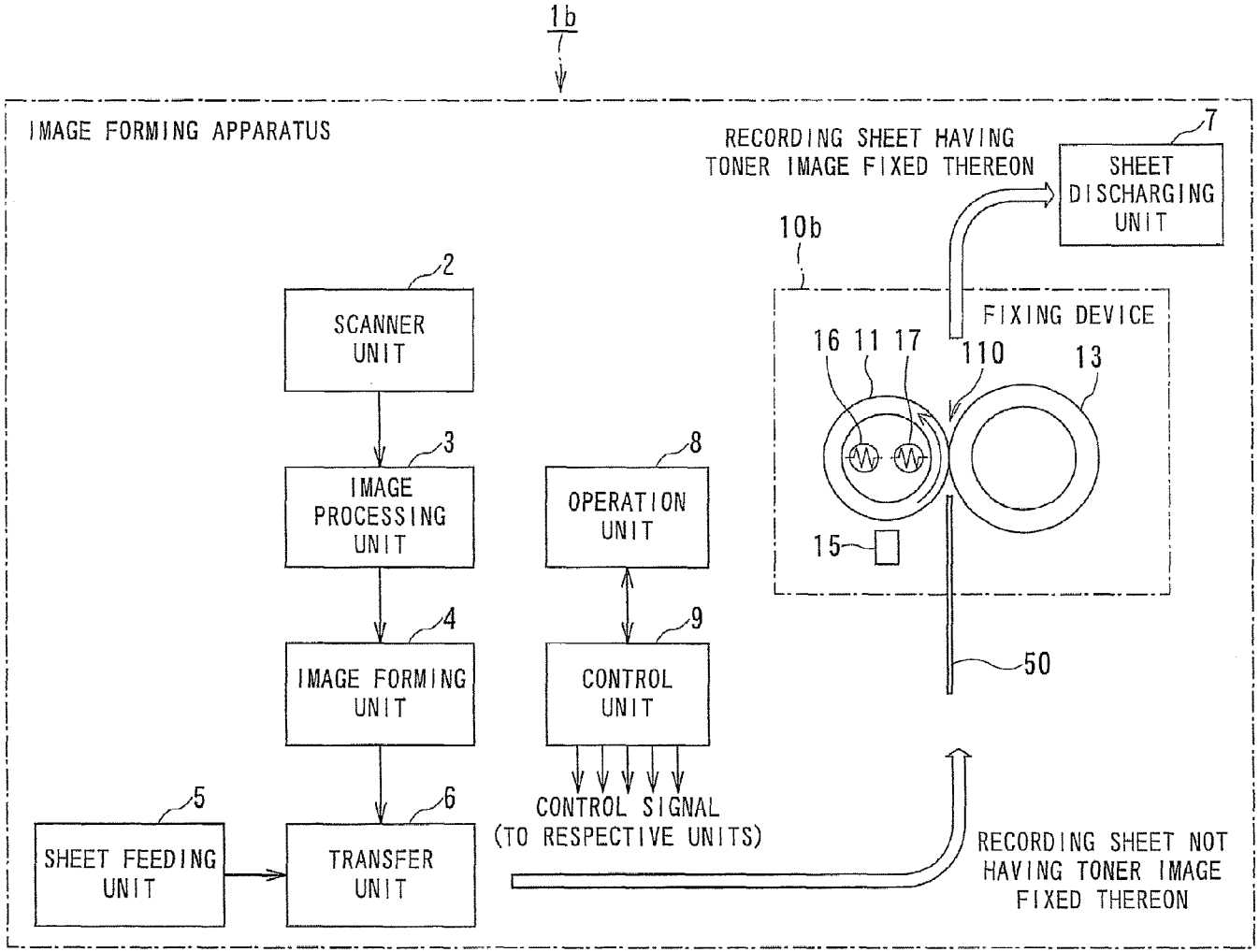
FIG. 3 is a diagram showing an example of an overall structure of an image forming apparatus according to a third embodiment of the invention.

Besides, as in an image forming apparatus 1*b* according to a third embodiment shown in FIG. 3, the heating roller 11 and the pressure roller 13 are directly in contact with each other without the intervention of the fixing belt 14 to form the nip portion 110. In this case, as in the above case, both the main heater 16 and the auxiliary heater 17 may be built in the heating roller 11 as shown in FIG. 3. Alternatively, although not shown in the figure, it is also possible that the main heater 16 is built in the heating roller 11 and the auxiliary heater 17 is built in the pressure roller 13.

(2) Control Method of an Image Forming Apparatus

Figure 4:
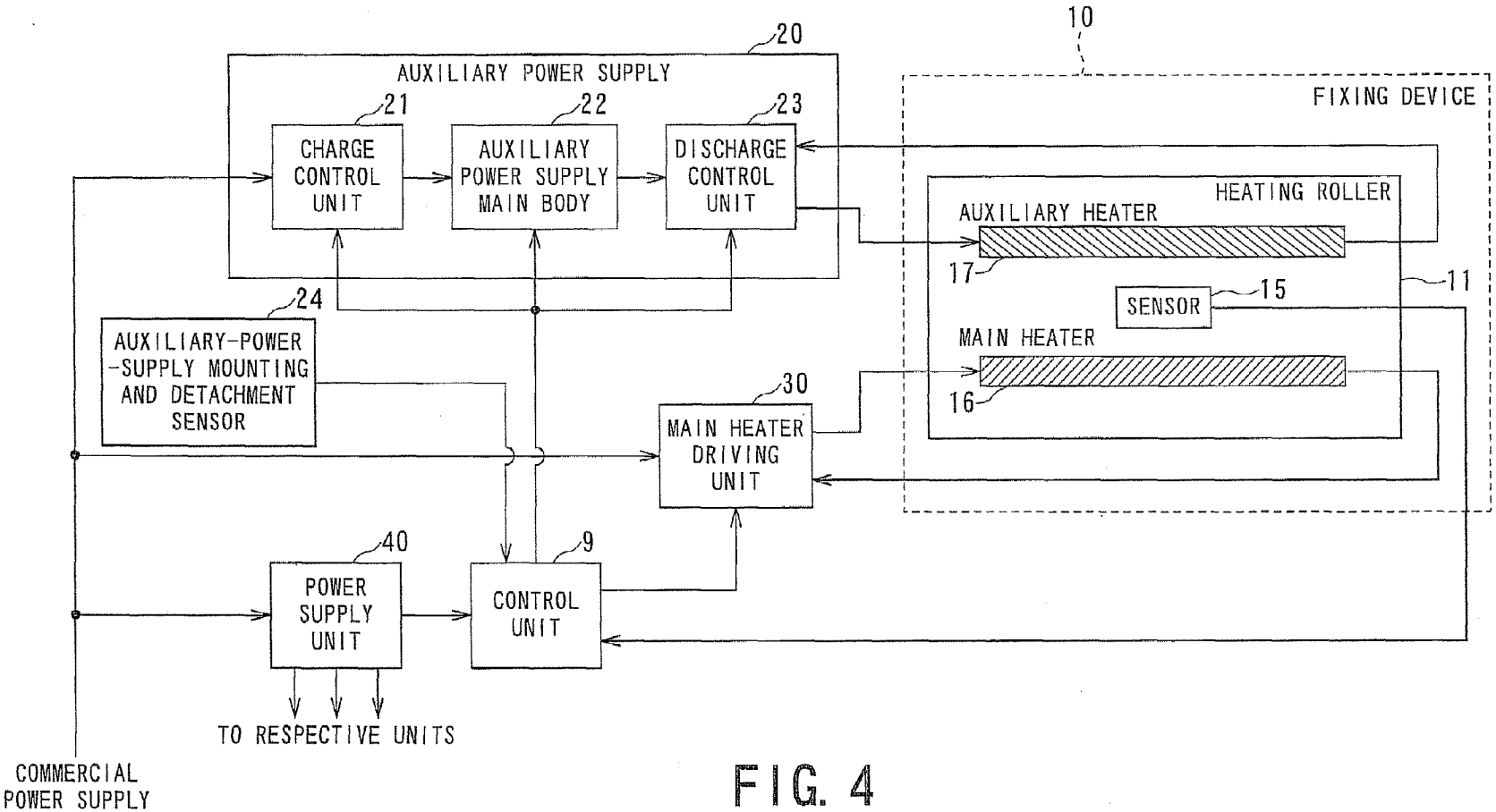

FIG. 4 is a diagram showing an example of a detail structure related to control of the main heater 16 and the auxiliary heater 17, the auxiliary power supply 20 that supplies electric power to the auxiliary heater 17, and the like.

The main heater 16 is driven by electric power of the commercial power supply via a main heater driving unit 30. The main heater driving unit 30 drives the main heater 16 by turning on and off the commercial power supply. Besides, the main heater driving unit 30 may drive the main heater 16 by changing electric power supplied to the main heater 16. The control unit 9 controls the main heater driving unit 30 on the basis of an operation state of the image forming apparatus 1 and a detected temperature of the temperature sensor 15.

On the other hand, the auxiliary heater 17 is driven by electric power supplied from the auxiliary power supply 20. The auxiliary power supply 20 includes, for example, an auxiliary power supply main body 22 constituted by an electric double layer capacitor or a large capacity battery, a charge control unit 21 that performs charging control for the auxiliary power supply main body 22, and a discharge control unit 23 that performs control of discharge from the auxiliary power supply main body 22.

The auxiliary power supply 20 is configured to be detachably mountable on the image forming apparatus 1. As described later, the auxiliary power supply 20 is mounted on the image forming apparatus 1 when continuous printing of sheets is carried out at speed higher than normal printing speed. On the other hand, the mounting of the auxiliary power supply 20 is unnecessary when the continuous printing of sheets is carried out at the normal printing speed.

An auxiliary-power-supply mounting and detachment sensor (a detector or detecting means) 24 is a sensor that detects mounting or un-mounting of the auxiliary power supply 20. As the auxiliary-power-supply mounting and detachment sensor 24, a mechanical sensor, an optical sensor, or the like is used.

The auxiliary power supply 20 is a power supply for driving and heating the auxiliary heater 17. When the auxiliary power supply 20 is not mounted, the auxiliary heater 17 is not heated.

When the auxiliary power supply 20 is mounted on the image forming apparatus 1, a detection signal of the auxiliary-power-supply mounting and detachment sensor 24 is transmitted to the control unit 9. The control unit 9 detects that the auxiliary power supply 20 is mounted.

When the control unit 9 detects the mounting of the auxiliary power supply 20, the control unit 9 charges the auxiliary power supply 20 via the charging control unit 21 on the basis of a charging amount of the auxiliary power supply 20 and an operation state of the image forming apparatus 1. During printing, the control unit 9 heats the auxiliary heater 17 via the discharge control unit 23 using electric power charged in the auxiliary power supply 20.

When the auxiliary power supply 20 is not mounted, a fixing heat source of the fixing device 10 is only the main heater 16. However, when the auxiliary power supply 20 is mounted and connected, it is possible to supply a heat quantity from the auxiliary heater 17 in addition to the main heater 16.

Figure 5A:
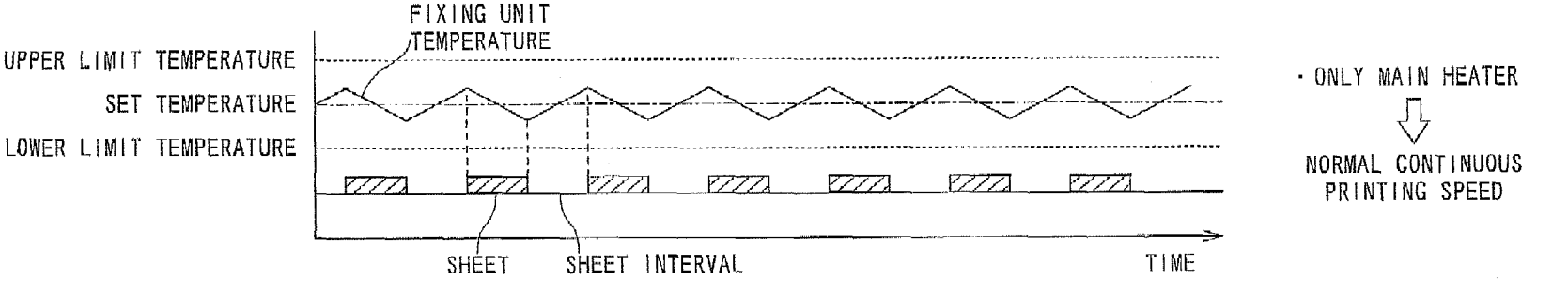
FIG. 5A is a diagram showing a state of a change in a fixing temperature at the time when only the main heater is used and printing speed during continuous printing is set to normal speed.

FIG. 5A is a diagram showing a state of a change in a fixing temperature at the time when printing speed during the continuous printing is set to normal speed. The fixing device 10 is heated by only the main heater 16.

For the image forming apparatus 1 employing the electrophotographic system such as this embodiment, one of factors determining printing speed is a heat quantity of the fixing device 10. Usually, in order to fix a toner formed as an image on a sheet, the temperature of the fixing device 10 has to be kept at temperature equal to or higher than a predetermined temperature. In other words, a heat quantity supplied to sheets by the fixing device 10 in a certain fixed time has to be larger than a sum of a heat quantity deprived by a toner fixing operation and a heat quantity deprived by other heat radiations.

FIG. 5A shows a state of a change in a fixing temperature in a state in which a relation between a heat quantity supplied and a heat quantity deprived is balanced. When a sheet is passing through the fixing device 10, since the heat quantity deprived is larger than the heat quantity supplied, the temperature of the fixing device 10 falls. However, in an interval between sheets, since the heat quantity supplied surpasses the heat quantity deprived, the temperature rises. According to the repetition of the fall and the rise of the temperature, the temperature of the fixing device 10 is kept in a predetermined range centered around a decided set temperature. In general, since the heat quantity supplied is larger, the heater in the fixing device 10 is controlled to keep a fixed temperature by turning off the heater at an appropriate period or reducing electric power supplied to the heater.

Figure 5B:
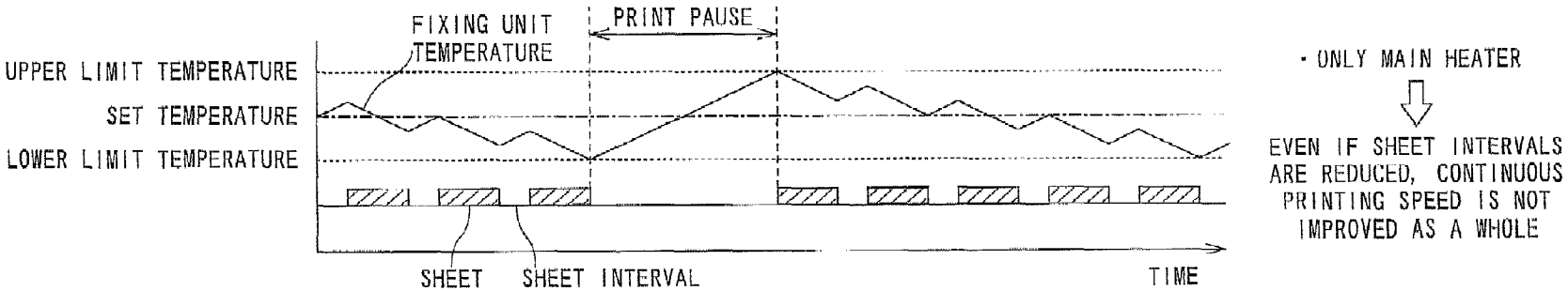
FIG. 5B is a diagram showing a state of a change in a fixing temperature at the time when only the main heater is used and printing speed during the continuous printing is set to high speed by reducing sheet intervals.

FIG. 5B is a diagram showing an example of a change in a fixing temperature, where a heat quantity supplied is unchanged (i.e., the fixing device 10 is heated by only the main heater 16), while sheet intervals are set shorter compared with that in FIG. 5A. This aims at increasing speed of the continuous printing by reducing the sheet intervals.

However, as shown in FIG. 5B, since the sheet intervals are short, it is impossible to sufficiently raise the temperature of the fixing device during this period and the fixing temperature gradually falls. When the fixing temperature falls below a lower limit temperature necessary for fixing, it is impossible to fix a toner on a sheet and a print defect occurs. Therefore, when the fixing temperature falls below the lower limit temperature, the continuous printing is stopped temporarily to recover the fixing temperature. When the fixing temperature rises to temperature equal to or higher than a certain fixed temperature, printing is resumed. Therefore, regardless of the fact that the sheet intervals are reduced, printing speed per a unit time is eventually unchanged.

This temperature fall is particularly conspicuous when the power supply for the image forming apparatus 1 is isolated, the power supply is turned on in a cold state, and a continuous printing operation is carried out immediately. For example, the fixing roller 12 and the pressure roller 13 located to be opposed to the heating roller 16, the other components of the fixing device 10, and the like are in a cooled state immediately after the power supply is turned on. In addition to the heat quantity deprived by the toner fixing operation, a heat dissipation amount for these components is large. Thus, the temperature fall increases. Incidentally, in general, the heat quantity supplied from the heater is set larger in order to cope with this period in which a largest heat quantity is required.

In this embodiment, in order to prevent this temperature fall, when printing is carried out at printing speed higher than a normal continuous printing speed, the fixing device 10 is heated by the auxiliary heater 17 in addition to the main heater 16.

Specifically, the control unit 9 checks whether the auxiliary power supply 20 is mounted and, when the auxiliary power supply 20 is mounted, performs control to supply electric power of the auxiliary power supply 20 to the auxiliary heater 17. At the same time, the control unit 9 controls the entire image forming apparatus 1 to carry out printing with shortened sheet intervals.

Figure 6:
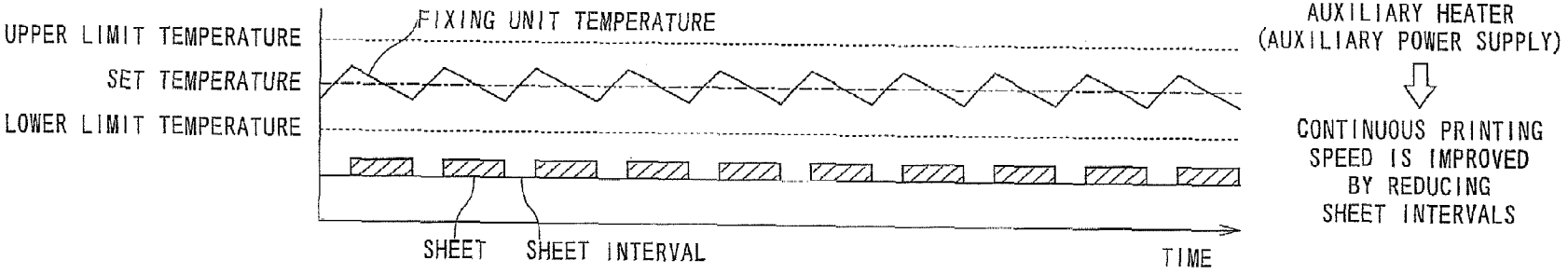
FIG. 6 is a diagram showing a state of a change in a fixing temperature at the time when both the main heater and the auxiliary heater are used and printing speed during the continuous printing is set to high speed by reducing sheet intervals.

FIG. 6 is a diagram showing a temperature change of the fixing device 10 in this state, i.e., in a state in which the fixing device 10 is heated by both the main heater 16 and the auxiliary heater 17 and, while the continuous printing is carried out with shortened sheet intervals.

Since both heat quantities of the main heater 16 and the auxiliary heater 17 are applied to the fixing device 10, a gradient of temperature rise is large compared with the case in which the fixing device 10 is heated by only the main heater 16. Even if sheet intervals are reduced, a fixing temperature does not fall below the lower limit temperature and is maintained within the allowable temperature range centered around the set temperature. As a result, it is possible to increase speed of the continuous printing.

In the image forming apparatus 1 according to this embodiment, the auxiliary power supply 20 is configured to be detachably mountable on the image forming apparatus 1 to make it possible to mount the auxiliary power supply 20 as an option. Therefore, when a user considers the normal continuous printing speed is enough, it is possible to provide the user with a low-cost image forming apparatus 1 not having the auxiliary power supply 20 mounted thereon.

In this form, since electric power of the commercial power supply is directly applied to the fixing device to heat the fixing device without using the auxiliary power supply 20, a power loss between charging electric power and discharging electric power does not occur. Thus, it is possible to realize high power use efficiency.

On the other hand, when a user desires printing speed higher than the normal continuous printing speed, it is possible to provide the user with the image forming apparatus 1 mounted with the auxiliary power supply 20 as an option. In this form, although cost is slightly increased, since electric power supplied to the fixing device 10 by the auxiliary power supply 20 increases, it is possible to carry out the continuous printing at speed higher than the normal continuous printing speed.

In the above explanation, as the method of increasing printing speed of the continuous printing, the method of reducing sheet intervals is explained. However, printing speed is improved in the same manner by a method of increasing overall conveyance speed of sheets while keeping sheet intervals the same as the normal sheet intervals.

Figure 7A:
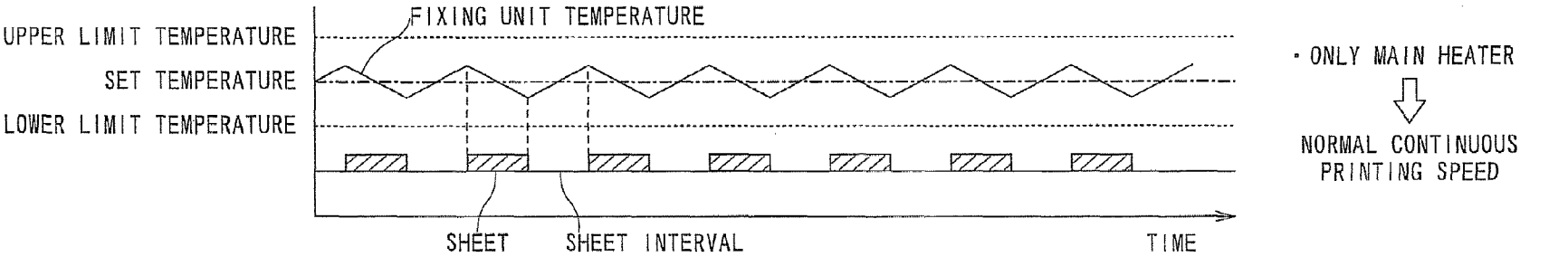
FIG. 7A is a diagram showing a state of a change in a fixing temperature at the time when only the main heater is used and printing speed during the continuous printing is set to normal speed.
Figure 7B:
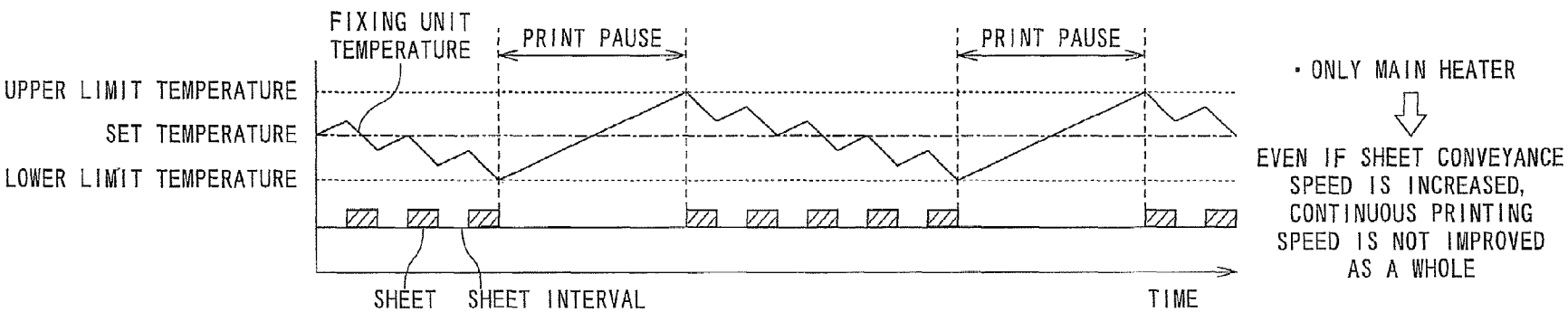
FIG. 7B is a diagram showing a state of a change in a fixing temperature at the time when only the main heater is used and printing speed during the continuous printing is set to high speed by increasing conveyance speed of sheets.

FIG. 7B is a diagram showing a change in a fixing temperature in the case in which conveyance speed of sheets is set higher than conveyance speed during the normal continuous printing using only the main heater 16 as a heat source for the fixing device 10. FIG. 7A shows, for comparison with FIG. 7B, a change in a fixing temperature at the normal conveyance speed at the time when only the main heater 16 is used. FIG. 7A is the same as FIG. 5A.

As it is seen from FIG. 7B, according to the increase in the conveyance speed of sheets, as in the case in which the sheet intervals are reduced, temperature rise in the sheet intervals becomes insufficient, the temperature of the fixing device 10 cannot be increased, and the fixing temperature gradually falls. When the fixing temperature falls below the lower limit temperature, the continuous printing is temporarily stopped to recover the fixing temperature and, when the fixing temperature reaches temperature equal to or higher than a certain fixed temperature, the printing is resumed. As a result, regardless of the fact that the conveyance speed is increased, printing speed per a unit time does not change.

On the other hand, in this embodiment, in order to prevent this temperature fall, when printing is carried out at printing speed higher than the normal continuous printing speed, i.e., when the conveyance speed of sheets is increased, the fixing device 10 is heated by the auxiliary heater 17 in addition to the main heater 16.

In this form, as in the form described above, the control unit 9 checks whether the auxiliary power supply 20 is mounted and, when the auxiliary power supply 20 is mounted, performs control to supply electric power of the auxiliary power supply 20 to the auxiliary heater 17. At the same time, the control unit 9 controls the entire image forming apparatus 1 to carry out printing at increased conveyance speed of sheets.

Figure 8:
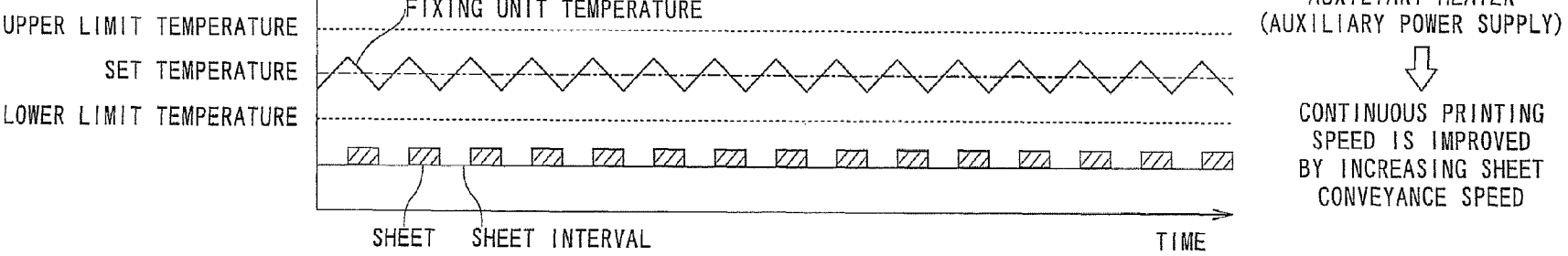
FIG. 8 is a diagram showing a state of a change in a fixing temperature at the time when both the main heater and the auxiliary heater are used and printing speed during the continuous printing is set to high speed by increasing conveyance speed of sheets.

FIG. 8 is a diagram showing a temperature change of the fixing device 10 in this state, i.e., a state in which the heating device 10 is heated by both the main heater 16 and the auxiliary heater 17, while the continuous printing is carried out at increased conveyance speed of sheets.

In this case, since heat quantities of both the main heater 16 and the auxiliary heater 17 are applied to the fixing device 10, a gradient of temperature rise is large compared with the case in which the fixing device 10 is heated by only the main heater 16. As in FIG. 6, even if the conveyance speed of sheets is increased, the fixing temperature does not fall below the lower limit temperature and is maintained within the allowable temperature range centered around the set temperature.

In this way, it is possible to heat both the auxiliary heater 17 and the main heater 16 by mounting the auxiliary power supply 20 as an option. As a result, even if the intervals of sheets are reduced or even if the conveyance speed of sheets is increased, it is possible to maintain the fixing temperature in the predetermined range and improve continuous printing speed.

Even when the auxiliary power supply 20 is mounted as an option, it is not always necessary to drive the auxiliary heater 17 and the main heater 16 simultaneously.

Figure 9:
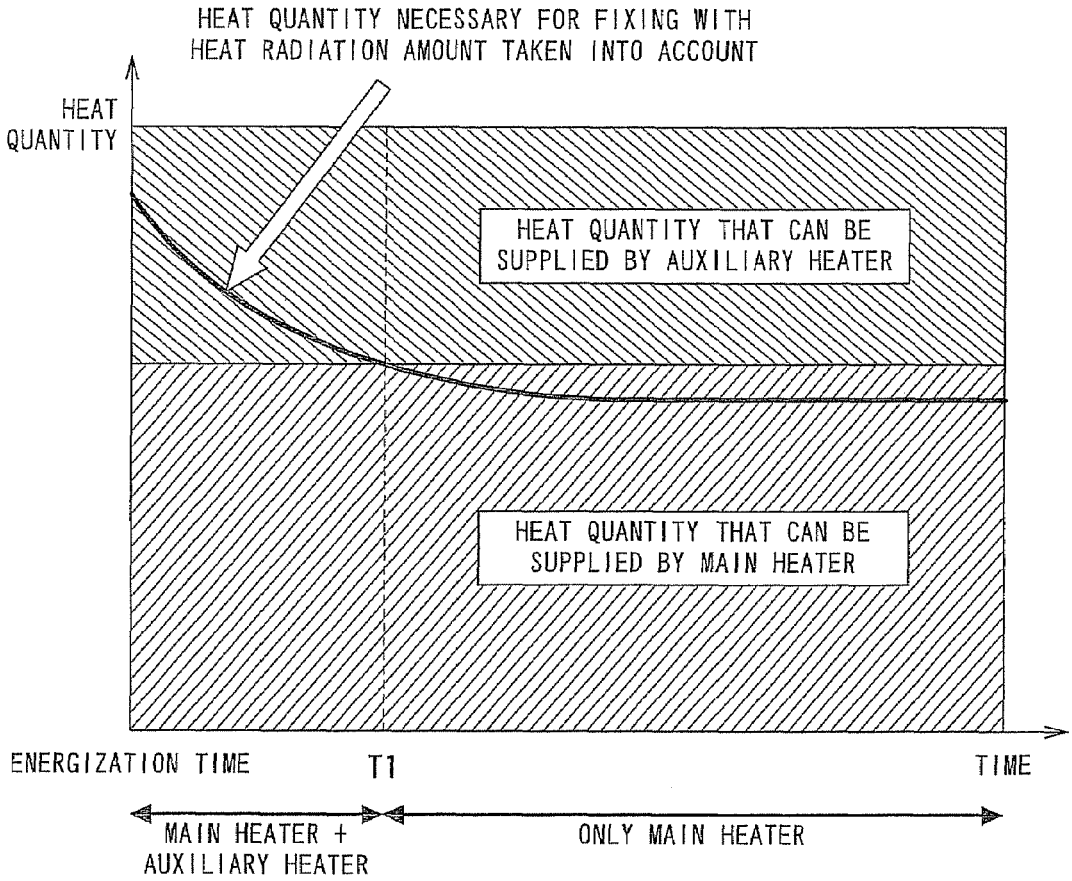
FIG. 9 is a diagram schematically showing a relation between elapsed time after starting energization of an image forming apparatus and a heat quantity necessary for fixing.

FIG. 9 is a diagram schematically showing a relation between elapsed time after start of energization of the image forming apparatus 1 and a heat quantity necessary for fixing.

As described above, a period in which a largest heating quantity is required is a period in which the power supply is turned on from the cold state of the apparatus body and then the continuous printing operation is immediately carried out. When time elapses to a certain degree, the components of the fixing device 10 are heated and the temperature thereof rises. Therefore, the heat quantity deprived by heat dissipation other than the fixing operation is reduced, and it is possible to maintain the temperature without complementation of the heat quantity of the auxiliary heater 17.

In short, as indicated by a curve of a solid line in FIG. 9, a heat quantity necessary for fixing with a heat dissipation amount taken into account is the largest during start of energization, gradually decreases after that, and, when T1 elapses from the start of energization, decreases to be equal to or smaller than a heat quantity that can be supplied by only the main heater 16.

Therefore, a period in which it is necessary to heat the fixing device 10 using both the auxiliary heater 17 and the main heater 16 is a period from the start of energization to T1. After T1, even when the continuous printing at speed higher than the normal speed is carried out, heating by only the main heater 16 is sufficient. On the other hand, it is unnecessary to use the auxiliary power supply 20 in the continuous printing after T1. Charging work only has to be performed in a period in which a power consumption amount is small such as a standby state after printing.

As explained above, according to the image forming apparatus 1 according to this embodiment, since the auxiliary power supply 20 is configured to be detachably mountable to the image forming apparatus 1, it is possible to easily select mounting or not mounting of the auxiliary power supply 20 as an option.

When a user uses the image forming apparatus 1, for the user, it depends on an environment of use of the image forming apparatus 1 whether the user attaches importance to printing speed or energy saving and low cost. According to this embodiment, it is easy for the user to make selection that, when the user desires high-speed continuous printing, the auxiliary power supply 20 is mounted and, when the user attaches importance to energy saving and low cost, the auxiliary power supply 20 is not mounted.

Conventionally, in image forming apparatuses of this type, printing speed depends on the apparatuses. Thus, a user has to determine printing speed in advance before purchasing an image forming apparatus. However, in the image forming apparatus 1 according to this embodiment, it is also possible to increase printing speed even after purchasing the image forming apparatus 1 by mounting the auxiliary power supply 20 thereon. Therefore, even when the frequency of use increases after the purchase and the user wants to increase continuous printing speed, it is unnecessary to replace the entire image forming apparatus 1.

The invention is not limited to the embodiments described above per se. At an implementation stage, it is possible to modify and embody the elements without departing from the spirit of the invention. It is possible to form various inventions according to appropriate combinations of the plural elements disclosed in the embodiments. For example, several elements may be deleted from all the elements described in the embodiments. Moreover, the elements described in the different embodiments may be combined as appropriate.

What is claimed is:

1. An image forming apparatus comprising:

an auxiliary power supply configured to be detachably mountable on the image forming apparatus;

a fixing device including a main heater heated by a commercial power supply and an auxiliary heater heated by the auxiliary power supply;

a detector that detects mounting and detachment of the auxiliary power supply; and a control unit configured to perform control to carry out, when the mounting of the auxiliary power supply is detected by the detector, continuous printing of sheets at printing speed higher than printing speed at the time when the auxiliary power supply is not mounted.

2. An image forming apparatus according to claim 1, wherein the control unit performs control to carry out the continuous printing at the high printing speed by reducing intervals of the sheets subjected to the continuous printing.

3. An image forming apparatus according to claim 1, wherein the control unit performs control to carry out the continuous printing at the high printing speed by increasing conveyance speed of sheets passing through the fixing device.

4. An image forming apparatus according to claim 1, wherein the control unit performs control to supply a heat quantity necessary for fixing using only the main heater after a predetermined time has elapsed from start of energization.

5. An image forming apparatus according to claim 4, wherein the control unit performs control to supply the heat quantity necessary for fixing using the main heater and the auxiliary heater in a period from the start of energization until the predetermined time elapses, and electric power of the auxiliary power supply is electric power that makes it possible to secure the heat quantity necessary for fixing from a heat quantity calculated by totaling a heat quantity obtained from the auxiliary heater by the electric power of the auxiliary power supply and a heat quantity obtained from the main heater.

6. An image forming apparatus according to claim 1, wherein the auxiliary power supply is a power supply chargeable by the commercial power supply.

7. An image forming apparatus according to claim 6, wherein the chargeable power supply is constituted by an electric double layer capacitor.

8. An image forming apparatus comprising:

means for supplying an auxiliary power supply configured to detachably mountable on the image forming apparatus;

fixing means including first heating means heated by a commercial power supply and second heating means heated by the means for supplying the auxiliary power supply;

detecting means for detecting mounting and detachment of the auxiliary power supply; and controlling means for performing control to carry out, when the means for supplying the auxiliary power supply is detected by the detecting means, continuous printing of sheets at printing speed higher than printing speed at the time when the means for supplying the auxiliary power supply is not mounted.

9. An image forming apparatus according to claim 8, wherein the controlling means performs control to carry out the continuous printing at the high printing speed by reducing intervals of the sheets subjected to the continuous printing.

10. An image forming apparatus according to claim 8, wherein the controlling means performs control to carry out the continuous printing at the high printing speed by increasing conveyance speed of the sheets passing through the fixing means.

11. An image forming apparatus according to claim 8, wherein the controlling means performs control to supply a heat quantity necessary for fixing using only the first heating means after a predetermined time has elapsed from start of energization.

12. An image forming apparatus according to claim 11, wherein the controlling means performs control to supply the heat quantity necessary for fixing using the first heating means and the second heating means in a period from the start of energization until the predetermined time elapses, and electric power of the means for supplying the auxiliary power supply is electric power that makes it possible to secure the heat quantity necessary for fixing from a heat quantity calculated by totaling a heat quantity obtained from the second heating means by the electric power of the means for supplying the auxiliary power supply and a heat quantity obtained from the first heating means.

13. A control method of an image forming apparatus including an auxiliary power supply configured to detachably mountable on the image forming apparatus and a fixing device including a main heater heated by a commercial power supply and an auxiliary heater heated by the auxiliary power supply, the control method of an image forming apparatus comprising:

detecting mounting and detachment of the auxiliary power supply; and when the mounting of the auxiliary power supply is detected, performing control to carry out continuous printing of sheets at printing speed higher than printing speed at the time when the auxiliary power supply is not mounted.

14. A control method of an image forming apparatus according to claim 13, wherein control is performed to carry out the continuous printing at the high printing speed by reducing intervals of the sheets subjected to the continuous printing.

15. A control method of an image forming apparatus according to claim 13, wherein control is performed to carry out the continuous printing at the high printing speed by increasing conveyance speed of the sheets passing through the fixing device.

16. A control method of an image forming apparatus according to claim 13, wherein control is performed to supply a heat quantity necessary for fixing using only the main heater after a predetermined time has elapsed from start of energization.

17. A control method of an image forming apparatus according to claim 16, wherein control is performed to supply the heat quantity necessary for fixing using the main heater and the auxiliary heater in a period from the start of energization until the predetermined time elapses, and electric power of the auxiliary power supply is electric power that makes it possible to secure the heat quantity necessary for fixing from a heat quantity calculated by totaling a heat quantity obtained from the auxiliary heater by the electric power of the auxiliary power supply and a heat quantity obtained from the main heater.

18. A control method of an image forming apparatus according to claim 13, wherein the auxiliary power supply is a power supply chargeable by the commercial power supply.

19. A control method of an image forming apparatus according to claim 18, wherein the chargeable power supply is constituted by an electric double layer capacitor.

* * * * *